US011242676B2

(12) United States Patent
Wang

(10) Patent No.: US 11,242,676 B2
(45) Date of Patent: Feb. 8, 2022

(54) DRAIN ASSEMBLY

(71) Applicant: Zhejiang Delifu Technology Co., Ltd., Ningbo (CN)

(72) Inventor: Guofei Wang, Ningbo (CN)

( * ) Notice: Subject to any disclaimer, the term of this patent is extended or adjusted under 35 U.S.C. 154(b) by 0 days.

(21) Appl. No.: 16/888,581

(22) Filed: May 29, 2020

(65) Prior Publication Data

US 2021/0372105 A1 Dec. 2, 2021

(51) Int. Cl.
*E03C 1/23* (2006.01)
*E03C 1/262* (2006.01)

(52) U.S. Cl.
CPC ..... *E03C 1/2302* (2013.01); *E03C 1/262* (2013.01)

(58) Field of Classification Search
CPC ..... E03C 1/2302; E03C 1/2304; E03C 1/2317
See application file for complete search history.

(56) References Cited

U.S. PATENT DOCUMENTS 4,594,738 A * 6/1986 Gebert ..... E03C 1/232 251/294
7,886,372 B2 * 2/2011 Jacobs ..... E03C 1/2304 4/295
10,151,087 B1 * 12/2018 Wang ..... E03C 1/2302
2011/0271442 A1 * 11/2011 Cen ..... E03C 1/2304 4/689

* cited by examiner

*Primary Examiner* — Janie M Loeppke
(74) *Attorney, Agent, or Firm* — W&K IP

(57) ABSTRACT

The present disclosure discloses a drain assembly, has a downpipe and a sealing plug; the upper end opening of the downpipe is provided with a connecting pipe seat by integral molding and the upper end opening of the connecting pipe seat serves as a sewer outlet; the downpipe and the connecting pipe seat internally share a connector that can move upward or downward; the upper end part of the connector is linked with the sealing plug; the pipe wall of the downpipe is integrally provided with a guide seat at the position corresponding to the lower end part of the connector; the guide seat is communicated with interior of the downpipe. Furthermore, the stay wire component is elastically clamped on the downpipe through a wave spring, therefore, the installation speed is increased and the sealing effect of the connection is ensured.

8 Claims, 5 Drawing Sheets

DRAIN ASSEMBLY

TECHNICAL FIELD

The present invention relates to the field of bathroom equipment, in particular to a drain assembly.

BACKGROUND

Drainage structures are typically used in household bathroom equipment, such as, a sink, a wash basin and the like. As a conventional drainage device, a drain assembly is embedded at the bottom of a sink so as to communicate the sink with a sewer line, such that it serves as sealing for water storage in need of retaining water, and discharges water into the sewer line if drainage is required. However, during drainage, a user needs to wet his/her hand in water to open the drain assembly at the bottom of the sink, in such a case, if the sink is relatively deeper or water in the sink is dirty, or cold in winter, the above operation causes great inconvenience to users.

In view of the above, there needs to provide a drain assembly which allows the user to open the sink without wetting his/her hand to realize the disposing of water.

SUMMARY

The present disclosure is to provide a drain assembly, for resolving the shortcomings of an existing drain assembly in drainage caused by its inconvenience in opening as mentioned in the background.

The technical solution of the present disclosure is to provide a drain assembly, comprising a downpipe and a sealing plug; the upper end opening of the downpipe is provided with a connecting pipe seat by integral molding and the upper end opening of the connecting pipe seat serves as a sewer outlet; the sealing plug is positioned at the sewer outlet to open or close the sewer outlet; the downpipe and the connecting pipe seat internally share a connector that can move upward or downward; the upper end part of the connector is linked with the sealing plug; a guide seat is integrally arranged at the position corresponding to the lower end part of the connector, on the pipe wall of the downpipe; the guide seat is communicated with interior of the downpipe, and a stay wire component having an operation end and an action end is elastically clamped on the guide seat through a wave spring; the action end of the stay wire component enters into the downpipe from the guide seat and then is linked with the lower end part of the connector; the operation end of the stay wire component is positioned outside the downpipe.

Compared with the prior art, the drain assembly provided by the present invention has the following beneficial effects: by means of clamped linkage of the stay wire component and the connector, and then by driving the sealing plug to open or close the sewer outlet through the connector, the effect of opening the sewer outlet is realized without wetting one's hand in water. Furthermore, the stay wire component is elastically clamped on the downpipe through a wave spring, therefore, the installation speed is increased and the sealing effect of the connection is ensured.

In some embodiment, the connector comprises a guiding rod and a connecting pole, and the guiding rod is positioned above the connecting pole; the sealing plug is in threaded connection with the upper end part of the guiding rod; the lower end part of the guiding rod is connected with the connecting pole; guiding sheets are integrally arranged on the rod body of the guiding rod, taking the rod body as the axis; the guiding rod and guiding sheets contribute to preventing the connector from deviation in the upward or downward movement process.

In some embodiment, the stay wire component comprises a toggled hook, a linkage rod, a stay wire and an operating rod. The toggled hook serves as the action end of the stay wire component, while the operating rod is the operation end of the stay wire component. The head of the toggled hook is hooked, while its body is sphere-shaped. A linkage seat is integrally formed on the body of the toggled hook. One end of the linkage rod is linked with the linkage seat, the other end thereof is connected with one end of the stay wire, and at the end part of the other end of the stay wire, there is a clamping element. Two ends of the clamping element respectively corresponding to the stay wire and the operating rod are integrally provided with clamping slots. The end part of the stay wire corresponding to the operating rod is integrally provided with a clamping head. The stay wire and the operating rod are in clamped linkage by means of the clamping element and the clamping head. The operating rod is pushed to drive the stay wire to pull the linkage rod, and the linkage rod pulls the toggled hook to rotate on a hinging seat, therefore, the head of the toggled hook stirs upward or downward in the downpipe, and then the toggled hook drives the connector to move upward or downward in the downpipe and the connecting pipe seat so as to open or close the sewer outlet by the sealing plug.

In some embodiment, the stay wire component further comprises a toggled hook seat, a fixing seat clamped with the toggled hook seat, and a connecting seat sheathed on the fixing seat and clamped with the guide seat. A splayed docking port is formed on the guide seat. The toggled hook seat is provided with a butt joint matching the docking port at its one side opposite to the guide seat in a raised manner. The interior of the toggled hook seat clamped with the fixing seat is provided with a mounting cavity in which a hinging seat is positioned. The body of the toggled hook is hinged on the hinging seat. The head of the toggled hook penetrates through the butt joint from the toggled hook seat into the downpipe and is clamped with the connecting pole. One end of the linkage rod is connected with the stay wire in the fixing seat, while the other end thereof penetrates through the hinging seat and is hinged on the linkage seat. The wave spring is positioned between the connecting seat and the fixing seat. The outer wall of the connecting seat is in rotary clamping with the guide seat, thereby realizing rapid connection of the stay wire component and the guide seat, achieving rapid positioning of connection of the toggled hook and the connector, and facilitating rapid connection of the connecting pole and the toggled hook.

In some embodiment, the lower end part of the connecting pole is integrally provided with a toggled hook fastener toward which the head of the toggled hook faces. The end of the head of the toggled hook is integrally provided with a clamp matching the toggled hook fastener. The toggled hook is clamped with the connecting pole through the clamp and the toggled hook fastener, such that the toggled hook and the connecting pole can be rapidly connected.

In some embodiment, on the pipe wall of the connecting pipe seat, there also provides an overflow outlet communicated with an overflow hole of a sink.

In some embodiment, the sewer outlet of the connecting pipe seat is embedded with a filtering stand. The guiding rod centrally penetrates through the filtering stand to be linked with the sealing plug so as to prevent the downpipe from being plugged. In case of cleaning the filtering stand, a user may separate the bottom of the connector from the toggled hook by poking the sealing plug, then the connector together with the sealing plug and the filtering stand is taken out, the filtering stand is cleaned, and after cleaning, the above components are wholly reassembled.

In some embodiment, an auxiliary mounting seat capable of assisting installation of the drain assembly is sheathed between the downpipe and the connecting pipe seat.

Figure 1:
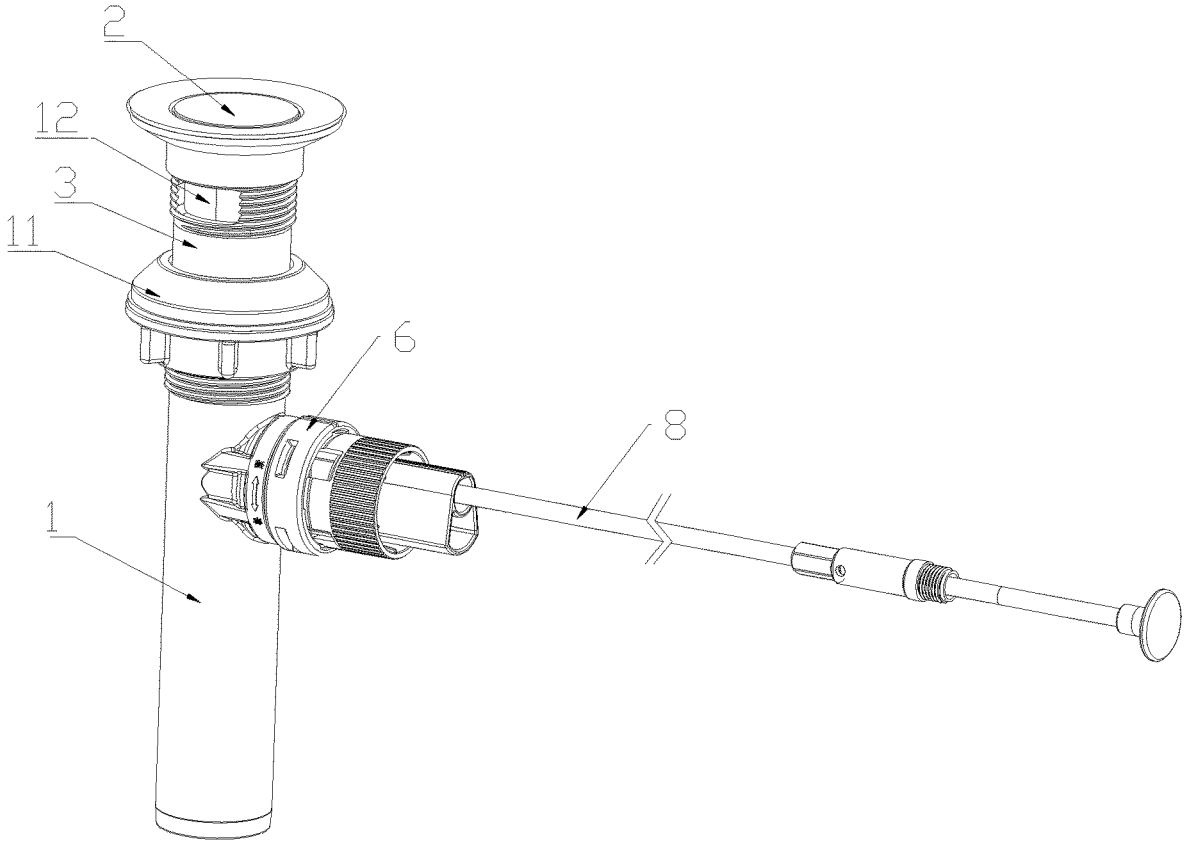
FIG. 1 is a structural schematic diagram of the present invention.
Figure 2:
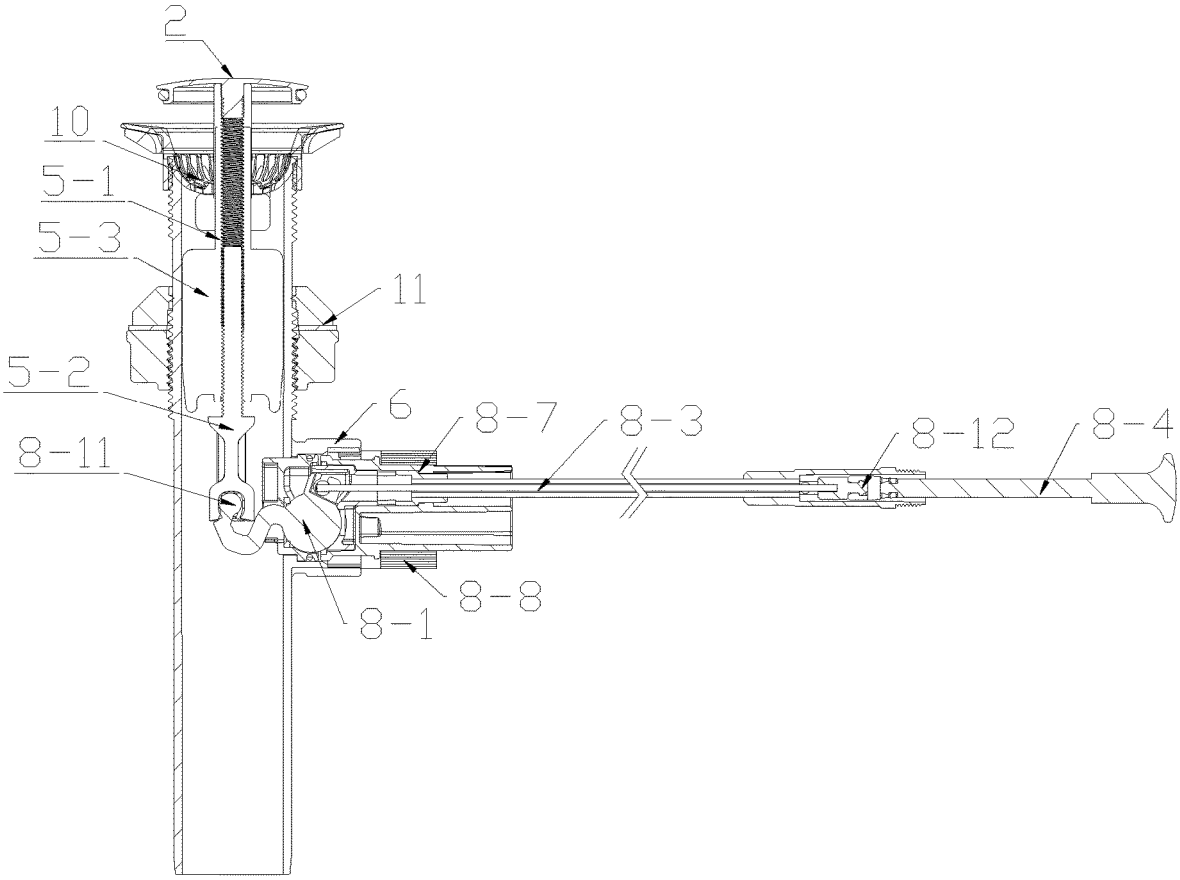
FIG. 2 is a cross-section of the present invention.
Figure 3:
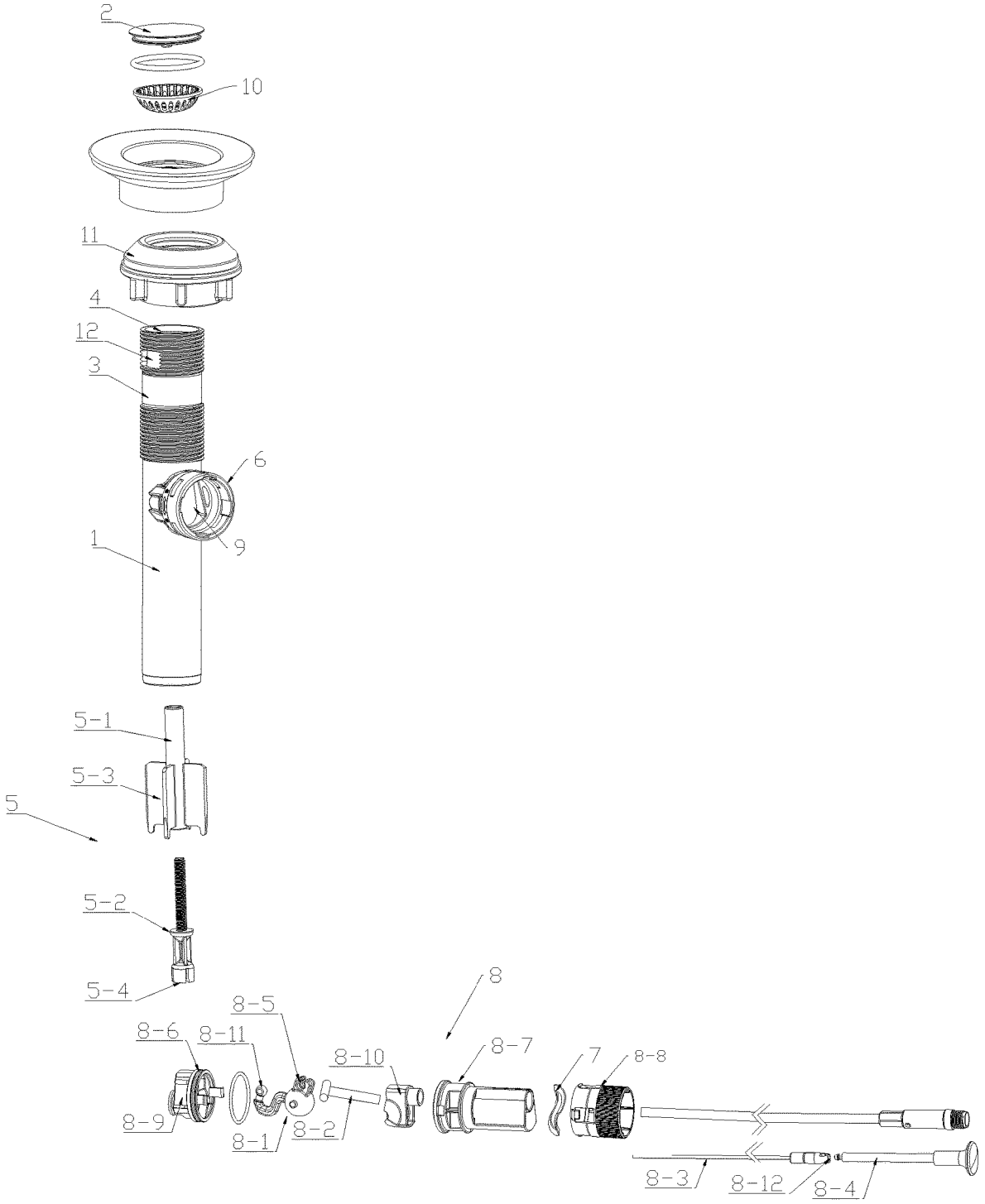
FIG. 3 is an explosive view of the present invention.
Figure 4:
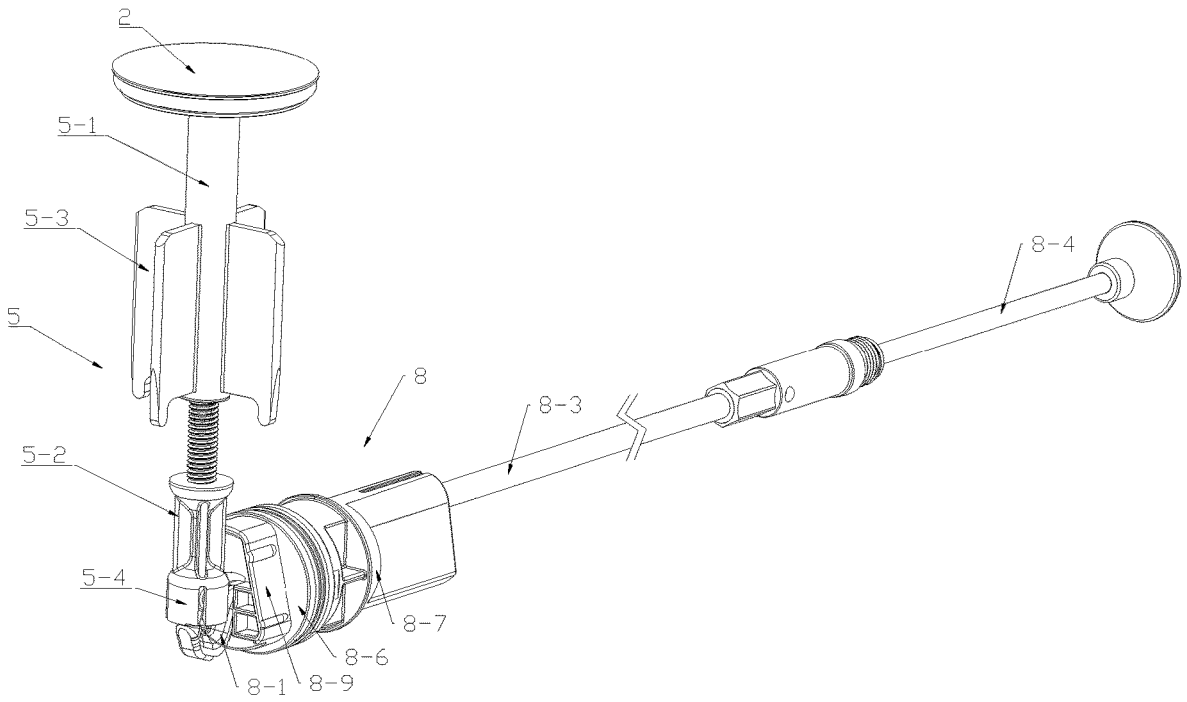
FIG. 4 is a structural schematic diagram of a connector and a stay wire component of the present invention.

Reference numerals represent: 1. downpipe; 2 sealing plug; 3 connecting pipe seat; 4 sewer outlet; 5 connector; 5-1 guiding rod; 5-2 connecting pole; 5-3 guiding sheets; 5-4 toggled hook fastener; 6 guide seat; 7 wave spring; 8 stay wire component; 8-1 toggled hook; 8-2 linkage rod; 8-3 stay wire; 8-4 operating rod; 8-5 linkage seat; 8-6 toggled hook seat; 8-7 fixing seat; 8-8 connecting seat; 8-9 butt joint; 8-10 hinging seat; 8-11 clamp; 8-12 clamping element; 9 docking port; 10 filtering stand; 11 auxiliary mounting seat; 12 overflow outlet.

EMBODIMENTS

A clear and complete description about the technical solutions of the embodiments of the present disclosure will be given by referring to the accompanying drawings therein. Apparently, the described is merely about a portion of, not all the embodiments of the present invention. Taking the embodiments of the present invention as the basis, any other embodiments obtained by an ordinary skilled without paying any creative effort will fall into the scope claimed by the present invention.

Figure 5:
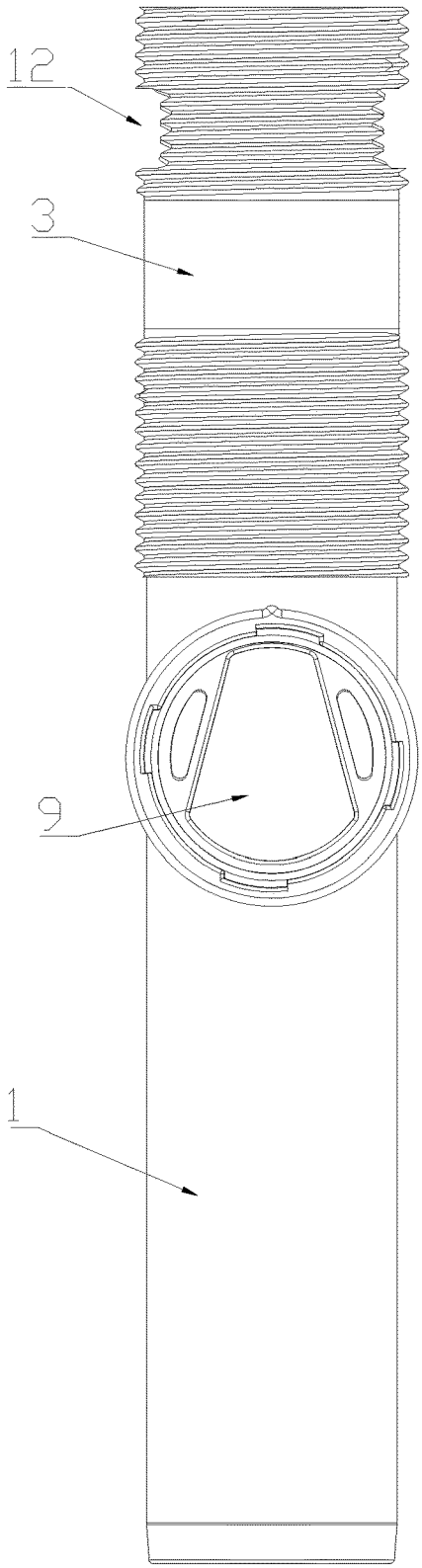
FIG. 5 is a structural schematic diagram of a downpipe of the present invention.

Referring to FIGS. 1-4, the technical solution provided by the present invention discloses a drain assembly, comprising a downpipe 1 and a sealing plug 2, and the upper end opening of the downpipe 1 is provided with a connecting pipe seat 3 by integral molding. An auxiliary mounting seat 11 capable of assisting installation of the drain assembly is sheathed at the joint between the downpipe 1 and the connecting pipe seat 3. The upper end opening of the connecting pipe seat 3 serves as a sewer outlet 4 that is embedded with a filtering stand 10. Due to absence of filtering equipment at the sewer outlet of a current water basin or sink, substances such as hair in sewage flow into the downpipe 1 through the sewer outlet to cause blockage of the downpipe. Therefore, in the present application, the filtering stand 10 is disposed at the sewer outlet 4 for filtering hair. The guiding rod 5-1 centrally penetrates through the filtering stand 10 to be linked with the sealing plug 2 so as to prevent the downpipe 1 from being plugged. The sealing plug 2 is positioned at the sewer outlet 4 to open or close the sewer outlet 4. In order to achieve a better sealing effect, a sealing ring is sheathed between the sealing plug 2 and its corresponding sewer outlet 4. To make the sealing plug 2 move upward or downward, the downpipe 1 and the connecting pipe seat 3 internally share a connector 5. The connector 5 consists of a guiding rod 5-1 and a connecting pole 5-2. The guiding rod 5-1 is positioned above the connecting pole 5-2. A connecting threaded passage is integrally formed in the guiding rod 5-1. The bottom end face of the sealing plug 2 is internally provided with a connecting stud. The sealing plug 2 is threaded on the upper end part of the guiding rod 5-1 through the connecting stud. The connecting pole 5-2 is threaded on the lower end part of the guiding rod 5-1 through the connecting threaded passage. On the rod body of the guiding rod 5-1, guiding sheets 5-3 are integrally distributed by taking the rod body as the axis, for the purpose of preventing the connector 5 from deviation in the upward or downward movement process. Propping the guiding sheets 5-3 against the inner wall of the connecting pipe seat 3 allows the connector 5 to move upward or downward in the vertical direction, thus the sealing plug 2 falls into the sewer outlet 4 accurately to close it. A guide seat 6 is integrally disposed at the position corresponding to the lower end part of the connecting pole 5-2, on the pipe wall of the downpipe 1. A splayed docking port 9 (as shown in FIG. 5) is formed on the guide seat 6. The docking port 9 is communicated with interior of the downpipe 1. A stay wire component 8 having an operation end and an action end is elastically clamped on the guide seat 6 through a wave spring 7. The action end of the stay wire component 8 enters into the downpipe 1 from the docking port 9 of the guide seat 6 and then is linked with the lower end part of the connector 5. The operation end of the stay wire component 8 is positioned outside the downpipe 1. The stay wire component 8 pulls the connector 5 to move upward or downward and further to drive the sealing plug 2 to open or close the sewer outlet 4.

The stay wire component 8 driving the connector 5 to move upward or downward inside the downpipe 1 and the connecting pipe seat 3 comprises a toggled hook 8-1, a linkage rod 8-2, a stay wire 8-3 and an operating rod 8-4. The toggled hook 8-1 serves as the action end of the stay wire component 8, while the operating rod 8-4 is the operation end of the stay wire component 8. The toggled hook 8 mainly comprises a head and a body, and the head of the toggled hook 8-1 is hooked, while its body is sphere-shaped. A linkage seat 8-5 is integrally formed on the body of the toggled hook 8-1. The head of the toggled hook 8-1 enters into the downpipe 1 through the docking port 9 and is clamped with the lower end part of the connecting pole 5-2. To be specific, the lower end part of the connecting pole 5-2 is integrally provided with a toggled hook fastener 5-4 toward which the head of the toggled hook 8-1 faces. The end of the head of the toggled hook 8-1 is integrally provided with a clamp 8-11 matching the toggled hook fastener 5-4. The toggled hook 8-1 is clamped with the connecting pole 5-2 through the clamp 8-11 and the toggled hook fastener 5-4, such that the toggled hook 8-1 and the connecting pole 5-2 can be rapidly connected. One end of the linkage rod 8-2 is hinged with the hinging seat 8-10, the other end thereof is connected with one end of the stay wire 8-3, and the end part of the other end of the stay wire 8-3 is provided with a clamping element 8-12. Two ends of the clamping element 8-12 respectively corresponding to the stay wire 8-3 and the operating rod 8-4 are integrally provided with clamping slots. The end part of the stay wire 8-3 corresponding to the operating rod 8-4 is integrally provided with a clamping head. The stay wire 8-3 and the operating rod 8-4 are in clamped linkage by means of the clamping element 8-12 and the clamping head, and are respectively clamped on two ends of the clamping element 8-12 so as to rapidly connect the stay wire 8-3 and the operating rod 8-4.

Specially, one end of the linkage rod 8-2 hinged with the body of the toggled hook 8-1 is connected with a linkage head. The linkage seat 8-5 is provided with a first passage allowing the linkage head to pass through in the vertical direction and a second passage being vertical to the first passage and allowing the linkage head to reverse for 90°. The linkage rod 8-2 is positioned in the second passage after stretching into the second passage from the first passage with the help of the linkage head and then reversing for 90° so as to realize hinged linkage of the linkage rod 8-2 and the linkage seat 8-5.

Rapid clamping of the stay wire component 8 and the guide seat 6 is realized in such a structure that the stay wire component 8 further comprises a toggled hook seat, a fixing seat 8-7 clamped with the toggled hook seat, and a connecting seat 8-8 sheathed on the fixing seat 8-7 and clamped with the guide seat 6. The toggled hook seat is integrally provided with a protruding butt joint 8-9 matching the docking port 9 at its one side corresponding to the guide seat 6. The interior of the toggled hook seat clamped with the fixing seat 8-7 is provided with a mounting cavity in which a hinging seat 8-10 is positioned. The body of the toggled hook 8-1 is hinged on the hinging seat 8-10. The head of the toggled hook 8-1 penetrates through the butt joint 8-9 from the toggled hook seat into the downpipe 1 through the docking port 9 and is clamped with the connecting pole 5-2. To limit the movement direction of the toggled hook 8-1 at the butt joint 8-9, a limiting channel capable of limiting movement of the toggled hook 8-1 is provided on the butt joint 8-9, and two sides of a location corresponding to the limiting channel are provided with limiting blocks to limit the toggled hook 8-1 to move within the limiting channel. The stay wire 8-3 penetrates through the fixing seat 8-7 to be linked with the linkage rod 8-2. The wave spring 7 is positioned between the connecting seat 8-8 and the corresponding fixing seat 8-7. The outer wall of the connecting seat 8-8 is integrally provided with a positioning clamp block in a raised manner. A positioning clamp groove is integrally formed on the guide seat 6. The connecting seat 8-8 is clamped with the guide seat 6 by means of the positioning clamp groove and the positioning clamp block. The wave spring 7 in the connecting seat 8-8 props against the fixing seat 8-7, such that the fixing seat 8-7 can be steadily and sealingly connected on the guide seat 6, and sealed connection of the stay wire component 8 and the guide seat 6 is ensured.

On the pipe wall of the connecting pipe seat 3, there also provides an overflow outlet 12 communicated with an overflow hole of a sink.

The drain assembly provided by the present disclosure works as the following principle: when the drain assembly is used, the operating rod 8-4 is pushed or pulled to drive the stay wire 8-3 to move along with the operating rod 8-4; then the stay wire 8-3 drives the linkage rod 8-2 to allow the toggled hook 8-1 hinged with the linkage rod 8-2 to stir upward or downward in the mounting cavity; when the toggled hook 8-1 stirs upward, the connector 5 clamped with the head of the toggled hook 8-1 moves upward under the effect of the toggled hook 8-1, therefore, the sealing plug 2 is pushed away from the sewer outlet 4 to open the sewer outlet for drainage; and when the toggled hook 8-1 stirs downward, the connector 5 is driven to move downward, the sealing plug 2 is returned to the sewer outlet 4 so as to close the sewer outlet 4. In case of cleaning the filtering stand 10, a user may separate the bottom of the connector from the toggled hook 8-1 by poking the sealing plug 2, and then the connector 5 together with the sealing plug 2 and the filtering stand 10 is taken out, the filtering stand 10 is cleaned, and after cleaning, the above components are wholly reassembled.

Although detailed explanations have been given to the above embodiments of the present invention, it will be apparent to those skilled in the art that various modifications to the technical solutions of the embodiments or equivalent substitutions of partial technical features are also appreciated. Thus, it is intended that the present invention covers any modifications, equivalent substitutions or improvements made to the embodiments provided they come within the spirit and principle of the present invention.

I claim:

1. A drain assembly, comprising a downpipe (1) and a sealing plug (2), wherein an upper end opening of the downpipe (1) is provided with a connecting pipe seat (3) by integral molding and an upper end opening of the connecting pipe seat (3) serves as a sewer outlet (4); the sealing plug (2) is arranged at the sewer outlet (4) to open or close the sewer outlet (4); the downpipe (1) and the connecting pipe seat (3) internally share a connector (5) that can move upward or downward; an upper end part of the connector (5) is linked with the sealing plug (2); a pipe wall of the downpipe (1) is integrally provided with a guide seat (6) at a position corresponding to a lower end part of the connector (5); the guide seat (6) is communicated with an interior of the downpipe (1), and a stay wire component (8) having an operation end and an action end is elastically clamped on the guide seat (6) through a wave spring (7); the action end of the stay wire component (8) enters into the downpipe (1) from the guide seat (6) and is linked with the lower end part of the connector (5); the operation end of the stay wire component (8) is positioned outside the downpipe (1); the connector (5) comprises a guiding rod (5-1) and a connecting pole (5-2); the guiding rod (5-1) is positioned above the connecting pole (5-2); a lower end part of the guiding rod (5-1) is connected with the connecting pole (5-2); the stay wire component (8) comprises a toggled hook (8-1) and a toggled hook seat (8-6) provided with a protruding butt joint (8-9); head of the toggled hook (8-1) penetrates through the butt joint (8-9) from the toggled hook seat (8-6) into the downpipe (1) and is clamped with the connecting pole (5-2); a lower end part of the connecting pole (5-2) is integrally provided with a toggled hook fastener (5-4); an end of the head of the toggled hook (8-1) is integrally provided with a clamp (8-11) matching with the toggled hook fastener (5-4); and the toggled hook (8-1) is clamped with the connecting pole (5-2) through the clamp (8-11) and the toggled hook fastener (5-4).

2. The drain assembly of claim 1, wherein the sealing plug (2) is in threaded connection with an upper end part of the guiding rod (5-1); guiding sheets (5-3) are integrally arranged on a rod body of the guiding rod (5-1), taking the rod body as an axis.

3. The drain assembly of claim 2, wherein the stay wire component (8) further comprises a linkage rod (8-2), a stay wire (8-3) and an operating rod (8-4); the toggled hook (8-1) is the action end of the stay wire component (8), and the operating rod (8-4) is the operation end of the stay wire component (8); head of the toggled hook (8-1) is of hooked structure, and body of the toggled hook (8-1) is sphere-shaped; a linkage seat (8-5) is integrally formed on the body of the toggled hook (8-1); one end of the linkage rod (8-2) is linked with the linkage seat (8-5), and the other end of the linkage rod (8-2) is connected with one end of the stay wire (8-3); an end part of the other end of the stay wire (8-3) is provided with a clamping element (8-12); two ends of the clamping element (8-12) respectively corresponding to the stay wire (8-3) and the operating rod (8-4) are integrally provided with clamping slots; the end part of the stay wire (8-3) corresponding to the operating rod (8-4) is integrally provided with a clamping head; the stay wire (8-3) and the operating rod (8-4) are in clamped connection through the clamping element (8-12) and the clamping head.

4. The drain assembly of claim 3, wherein the stay wire component (8) further comprises a fixing seat (8-7) clamped with the toggled hook seat (8-6), and a connecting seat (8-8) sheathed on the fixing seat (8-7) and clamped with the guide seat (6); the guide seat (6) is provided with a docking port (9) of splayed shape; the butt joint (8-9) matches the docking port (9) at one side opposite to the guide seat (6); an interior of the toggled hook seat (8-6) clamped with the fixing seat (8-7) is provided with a mounting cavity in which a hinging seat (8-10) is positioned; the body of the toggled hook (8-1) is hinged on the hinging seat (8-10); one end of the linkage rod (8-2) is connected with the stay wire (8-3) in the fixing seat (8-7), and the other end of the linkage rod (8-2) penetrates through the hinging seat (8-10) and is hinged on the linkage seat (8-5); the wave spring (7) is arranged between the connecting seat (8-8) and the fixing seat (8-7) and an outer wall of the connecting seat (8-8) is in rotary clamping with the guide seat (6).

5. The drain assembly of claim 1, wherein a pipe wall of the connecting pipe seat (3) is provided with an overflow outlet (12) communicated with an overflow hole of a sink.

6. The drain assembly of claim 5, wherein the sewer outlet (4) of the connecting pipe seat (3) is embedded with a filtering stand (10); the guiding rod (5-1) penetrates through center of the filtering stand (10) to be linked with the sealing plug (2).

7. The drain assembly of claim 6, wherein an auxiliary mounting seat (11) assisting installation of the drain assembly is sheathed between the downpipe (1) and the connecting pipe seat (3).

8. The drain assembly of claim 1, wherein the head of the toggled hook (8-1) faces upwards toward the toggled hook fastener (5-4).

* * * * *